US006732378B2

(12) United States Patent
Novak

(10) Patent No.: US 6,732,378 B2
(45) Date of Patent: May 11, 2004

(54) GLOVE WITH TUCKS

(75) Inventor: Jerry R. Novak, Edina, MO (US)

(73) Assignee: Edina Manufacturing Co., Inc., Edina, MO (US)

( * ) Notice: Subject to any disclaimer, the term of this patent is extended or adjusted under 35 U.S.C. 154(b) by 34 days.

(21) Appl. No.: 10/006,761

(22) Filed: Dec. 6, 2001

(65) Prior Publication Data

US 2003/0106133 A1 Jun. 12, 2003

(51) Int. Cl.[7] ..... A41D 19/00
(52) U.S. Cl. ..... 2/161.6; 2/163; 2/169
(58) Field of Search ..... 2/163, 169, 161.6, 2/16.2, 160, 161.1–161.3, 166

(56) References Cited

U.S. PATENT DOCUMENTS

| | | | | |
|---|---|---|---|---|
| 2,650,365 A | | 9/1953 | Singer | |
| 3,548,413 A | | 12/1970 | Jackson | |
| 3,821,817 A | * | 7/1974 | Jorgensen | 2/169 |
| 3,822,417 A | * | 7/1974 | Lars-Jos | 2/169 |
| 4,000,524 A | | 1/1977 | Rinehart | |
| 4,245,357 A | * | 1/1981 | Connelly | 2/163 |
| 4,433,439 A | | 2/1984 | Sidman et al. | |
| 4,454,611 A | | 6/1984 | Tschirch et al. | |
| 4,654,896 A | * | 4/1987 | Rinehart | 2/163 |
| 4,831,667 A | * | 5/1989 | Town | 2/163 |
| 4,847,918 A | | 7/1989 | Sturm | |
| 4,918,756 A | | 4/1990 | Grilliot et al. | |
| 5,167,038 A | | 12/1992 | Rinehart | |
| 5,349,705 A | | 9/1994 | Ragan | |
| 5,598,582 A | | 2/1997 | Andrews et al. | |
| 5,740,551 A | | 4/1998 | Walker | |
| 5,822,796 A | * | 10/1998 | Harges, Jr. et al. | 2/161.6 |
| 5,857,216 A | * | 1/1999 | Gold | 2/169 |
| 5,924,137 A | * | 7/1999 | Gold | 2/161.1 |
| 6,021,523 A | | 2/2000 | Vero | |
| 6,115,850 A | | 9/2000 | Grilliot et al. | |
| 6,415,447 B1 | * | 7/2002 | Frazier | 2/165 |
| 6,427,250 B1 | * | 8/2002 | Stull et al. | 2/161.6 |

OTHER PUBLICATIONS

National Fire Protection Association Standards, 2000 editions, pp. 15–16.

What Every Member of the Trade Community Should d Know About: Gloves, Mittens & Mitts, 1998, pp. 1–12.

Important Changes in NFPA Standards on Fire Fighter Protective Clothing, pp. 1–10.

* cited by examiner

*Primary Examiner*—Katherine Moran
(74) *Attorney, Agent, or Firm*—Shook, Hardy & Bacon LLP

(57) ABSTRACT

A glove including a plurality of tucks formed in the fingers, thumb and in the back portion. The tucks positioned on the fingers and thumb are formed in the fourchette of each finger and thumb on both sides of a wearer's knuckles. The tucks formed in the back portion of the glove are located at the peripheral edge of back portion, on both sides of a wearer's hand. The tucks operate to shape the glove to the natural position of a wearer's hand. The tucks also provide for a pre-formed bending crease in the fourchettes to increase flexibility and reduce hand and finger fatigue of a wearer. The fourchettes and the back portion of the glove are formed of an aluminized radiant reflective material to protect a wearer from elevated temperatures.

33 Claims, 3 Drawing Sheets

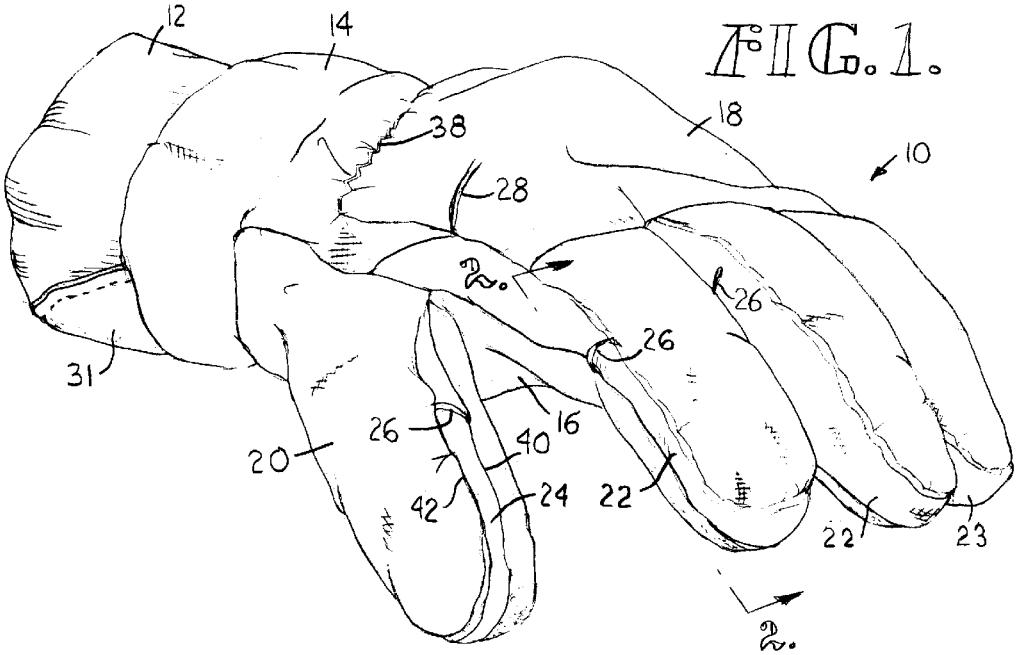
FIG. 1.
FIG. 2.
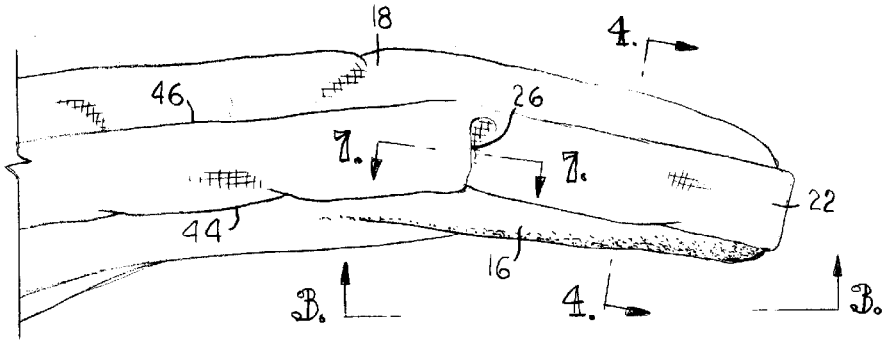
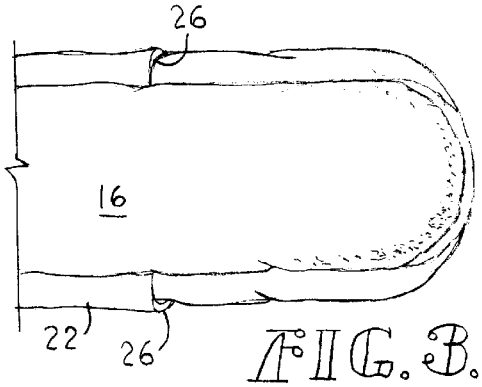
FIG. 3.
FIG. 4.
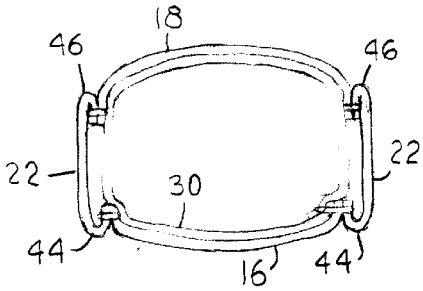

GLOVE WITH TUCKS

STATEMENT REGARDING FEDERALLY SPONSORED RESEARCH OR DEVELOPEMET

Not Applicable.

CROSS-REFERENCE TO RELATED APPLICATIONS

Not Applicable.

FIELD OF INVENTION

This invention relates to a glove, and, more particularly, to a glove having a plurality of tucks positioned in specific locations on the glove for improving flexibility and reducing the finger fatigue of a wearer. The glove further includes an aluminized shell to protect the wearer's hands and fingers from heat.

BACKGROUND OF INVENTION

There are various types of glove patterns that are well known in the art. For example, the clute, gun-cut and keystone are common glove patterns. These patterns are sometimes formed with tucks on the finger portion of the glove. In particular, the tucks are typically positioned on the back part of the knuckle to assist a wearer in moving is or her fingers. Additionally, the outside of the glove is sometimes formed of aluminization to prevent burning of the back of a wearer's hand when exposed to elevated temperatures.

Current state of the art in glove structure present a number of limitations. First, the positioning of the tucks on the back of the knuckles restrict the movement of a wearer's fingers. Typically, the tucks are constructed by folding and sewing the glove material across the back of a wearer's knuckles. When a wearer flexes his fingers, the material forming the tucks on the back of the knuckle is supposed to pull out, and retain some fold, when the finger is fully flexed so the wearer does not have to stretch the material over his knuckle. In fact, the prior art construction actually causes problems because the tuck bulks up and tightens the material on the back of the knuckle making it difficult for a wearer to flex his fingers. Thus, the positioning of the tucks on the back of the knuckle limit the finger flexibility of a wearer.

Second, the glove designs discussed above provide inadequate protection when a wearer is exposed to elevated temperatures. For instance, a firefighter is often exposed to high temperature environments which are hot enough to cause bums. In order to prevent their hands from sustaining bums, they wear gloves that have aluminization on the back portion of their hands, such as the prior art gloves described above. Although offering protection for the top of the hand, the wearer is still susceptible to sustaining bums on the sides of each finger due to the lack of heat resistant material in those locations.

In an effort to protect firefighters from sustaining bums on their hands, the National Fire Protection Association (NFPA) established several standards that apply to fire fighting gloves. Generally, proximity fire fighting gloves must include a radiant protection of 210 degrees (+20°/−0°) around the fingers, thumb and the back of the hand. Specifically, when a person points his finger towards his face, using a polar coordinate system, "[t]he radiant reflective material shall provide coverage from 0 degrees to 105 degrees (+10°/−0°) and then from 255 degrees (+10°/−0°) to 360 degrees . . . " (NFPA Protective Design Requirments 1976–2000 edition §4-3.6.1). Evan though the NFPA standards set forth the required coverage around the fingers, thumb and back of the hand, the standards do not specify how the glove should be constructed to meet these requirement. In fact, it has been difficult to construct a glove that meets the aforementioned standards.

Accordingly, there remains a need in the glove industry which overcomes the above drawbacks and deficiencies. More specifically, there remains a need for a glove construction that will increase the flexibility and reduces hand and finger fatigue of a wearer. In addition, there remains a need for a glove that will protect the sides of a wearer's fingers, thumb and back of the hand when exposed to elevated conditions and temperatures.

SUMMARY OF INVENTION

Accordingly, it is the object of the present invention to provide a glove for improving flexibility and reducing hand and finger fatigue of a wearer.

It is another object of the present invention to provide for a glove for improving flexibility, reducing hand and finger fatigue of a wearer and forming to the natural curvature of a wearer's hand.

It is still another object of the present invention to provide a method for constructing a glove for improving the flexibility and reducing hand and finger fatigue of a wearer.

It is a further object of the present invention to provide for a glove for protecting the back portion of a wearer's hands and the back and side portions of a wearer's fingers from elevated temperatures.

It is still a further object of the present invention to provide a method for constructing a glove that protects the back portion of a wearer's hands and the back and side portions of a wearer's fingers from elevated temperatures.

According to the present invention, the foregoing and other object are achieved by a glove having a palm and a back portions each with finger portions adapted to conform to the fingers of a wearer. The glove comprises a fourchette and a first tuck. The fourchette is adapted to couple the palm and back portions to form an enclosure for a wearer's fingers. The first tuck is adapted to be formed in the fourchette thereby allowing for the easy movement of a wearer's fingers.

The present invention further provides for a glove for improving the flexibility, reducing hand and finger fatigue of a wearer and forming to the natural curvature of a wearer's hand, the glove comprising a palm, a back portion and a sidewall. The palm and the back portion each have at least one finger portion formed therein. The sidewall is adapted to couple the palm to the back portion in the area of the finger portion. The sidewall has a first tuck formed therein to allow for easier movement of a wearer's finger.

The present invention also provides for a method for constructing a glove for improving the flexibility and reducing hand and finger fatigue of a wearer, the glove has a palm, a back portion and a fourchette. The palm and back portion each includes at least one finger portion. The fourchette is adapted to couple the palm and the back portion to one another. The method comprises the steps of coupling the palm and back portion with a fourchette and forming a first tuck in the fourchette to thereby reduce the amount of force needed to bend the finger portion of the glove.

The present invention further provides for a glove for protecting the back portion of a wearer's hands and the back and side portions of a wearer's fingers from elevated temperatures. The glove comprises a back portion, a palm portion and a fourchette. The back portion and the palm portion each have at least one finger portion. The fourchette is adapted to couple the back portion and the palm. The back portion and the fourchette are formed of radiant reflective material to protect the back portion of a wearer's hands and the back and side portions of a wearer's fingers.

The present invention also provides for a method for constructing a glove that protects the back portion of a wearer's hands and the back and side portions of a wearer's fingers from elevated temperatures. The glove includes a back portion, a palm portion and a fourchette. The back portion and the palm each include at least one finger portion. The fourchette is adapted to couple the back portion and the palm portion. The method comprises the steps of forming the back portion of a radiant reflective material, forming the fourchette of a radiant reflective material, coupling the back portion and the palm with the fourchette such that the back portion and the fourchette extend approximately 210 degrees around the circumference of the finger to protect the back portion and the sides of the wearer's finger from elevated temperatures.

Additional objects of invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means and instrumentalities and combinations particularly pointed out in the appended claims.

BRIEF DESCRIPTION OF THE DRAWINGS

In the accompanying drawings which form a part of this specification and are to be read in conjunction therewith and in which like reference numerals are used to indicate like parts in the various views:

FIG. 1 is a front perspective view of a glove having tucks formed in, and radiant material extending over, the fingers, thumb and back of the hand, in accordance with a preferred embodiment of the present invention;

FIG. 2 is a fragmentary right side elevational view of a finger on the glove in an extended position having a tuck formed therein;

FIG. 3 is a fragmentary bottom view of a finger having a tuck formed in the fourchettes;

FIG. 4 is a cross-sectional view taken along line 4—4 of FIG. 2 showing the back portion and palm coupled by fourchettes with a lining forming the interior of the glove;

DETAILED DESCRIPTION OF THE PREFERRED EMBODIMENT

Figure 5:
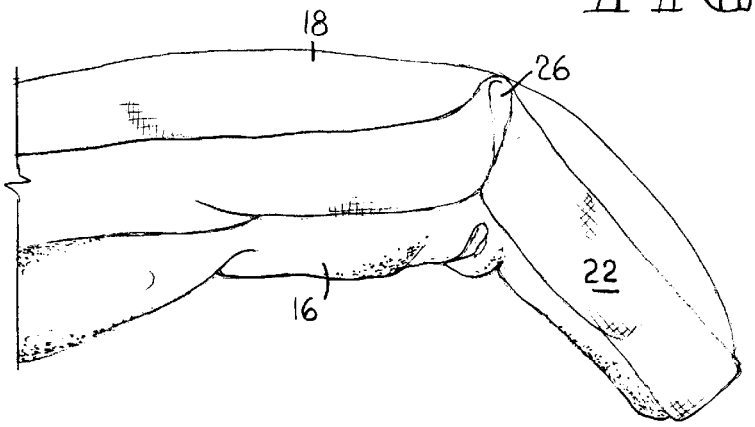
FIG. 5 is a fragmentary right side elevational view of a finger on the glove in a flexed position having a tuck formed therein.

The present invention is directed to a glove that improves the flexibility and reduces hand and finger fatigue of a wearer. The particular embodiments described herein are intended in all respects to be illustrative rather than restrictive. Alternative embodiments will become apparent to those skilled in the art to which the invention pertains without departing from its scope.

Referring to the drawings in greater detail, and initially to FIG. 1, an exemplary glove employing the principles of this invention is shown and broadly designated in the drawings by reference numeral 10. In its most basic configuration, glove 10 includes a cuff or wristlet 12 that is coupled to a collar 14. Even though cuff 12 is included in the preferred embodiment of the present invention, it should be understood that it is within the scope of the present invention to eliminate cuff 12 to form a gauntlet-type glove. If a gauntlet-type glove is formed, collar 14 is increased in length along the longitudinal axis of the glove and the sidewalls of collar 12 would be flared or tapered inwardly as collar 14 extends toward the opening of the glove.

In the preferred embodiment, the opposite edge of collar 14 is coupled to a palm 16, a back portion 18 and a top thumb portion 20 of glove 10. A first fourchette 22 forms the sidewall of the index and middle finger and couples palm 16 to back portion 18. A second fourchette 23 forms the sidewall of the ring and little finger and also couples palm 16 to back portion 18. A thumb fourchette 24 forms the sidewall of the thumb and couples to palm 16 to top thumb portion 20. A series of tucks 26, 28 are formed in fourchettes 22, 23, 24 and on back portion 18 respectively to provide for increased flexibility and reduces hand and finger fatigue of a wearer of glove 10. The interior portion of glove 10 includes a liner 30 that will be more fully described below.

Figure 6:
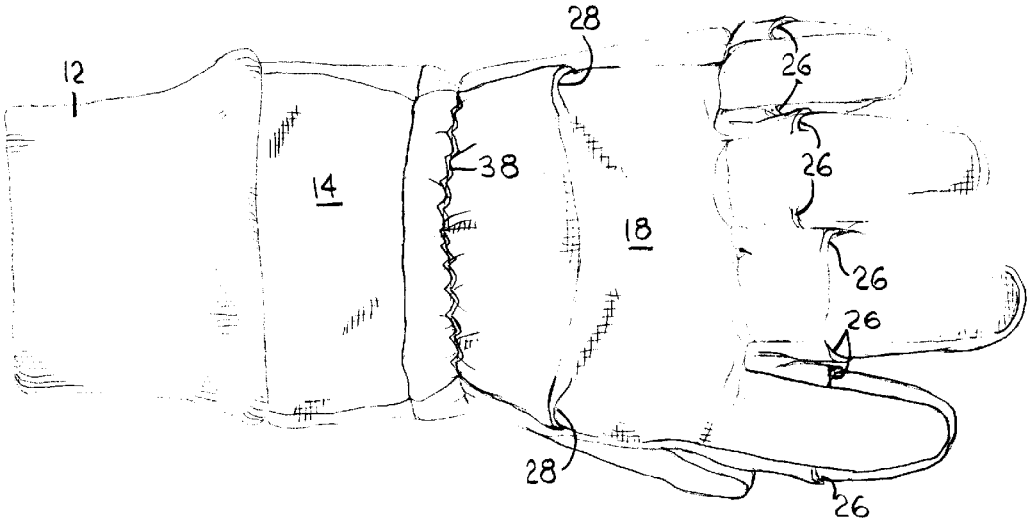
FIG. 6 is a plan view showing the tucks on the back portion of the glove and the tucks positioned formed in the fourchette of each finger.

As best seen in FIG. 1, cuff 12 is generally tubular and formed of an elastic-type fabric. Cuff 12 is positioned at the distal end of glove 10 and is adapted to accept the hand and lower forearm of a wearer. As a wearer puts his hand through cuff 12, it stretches around the lower forearm of a wearer to prevent debris from entering the interior portion of glove 10. An arching member or heel 31 is coupled to the bottom portion of cuff 12 and is preferably formed from a leather-type material such as cowhide, deerskin, elkskin, pigskin, digital leather or any combination thereof. Arching member 31 helps reduce the amount of wear on the bottom portion of cuff 12 and assists in preventing abrasions on the lower forearm of a wearer when using glove 10 during certain activities. As best seen in FIGS. 1 and 6, collar 14 is a cylindrical piece of radiant reflective aluminized material and couples cuff 12 to back portion 18, top thumb portion 20 and palm 16 of glove 10. It should be understood that collar 14 could also be made from a leather-type material as described above.

Figure 9:
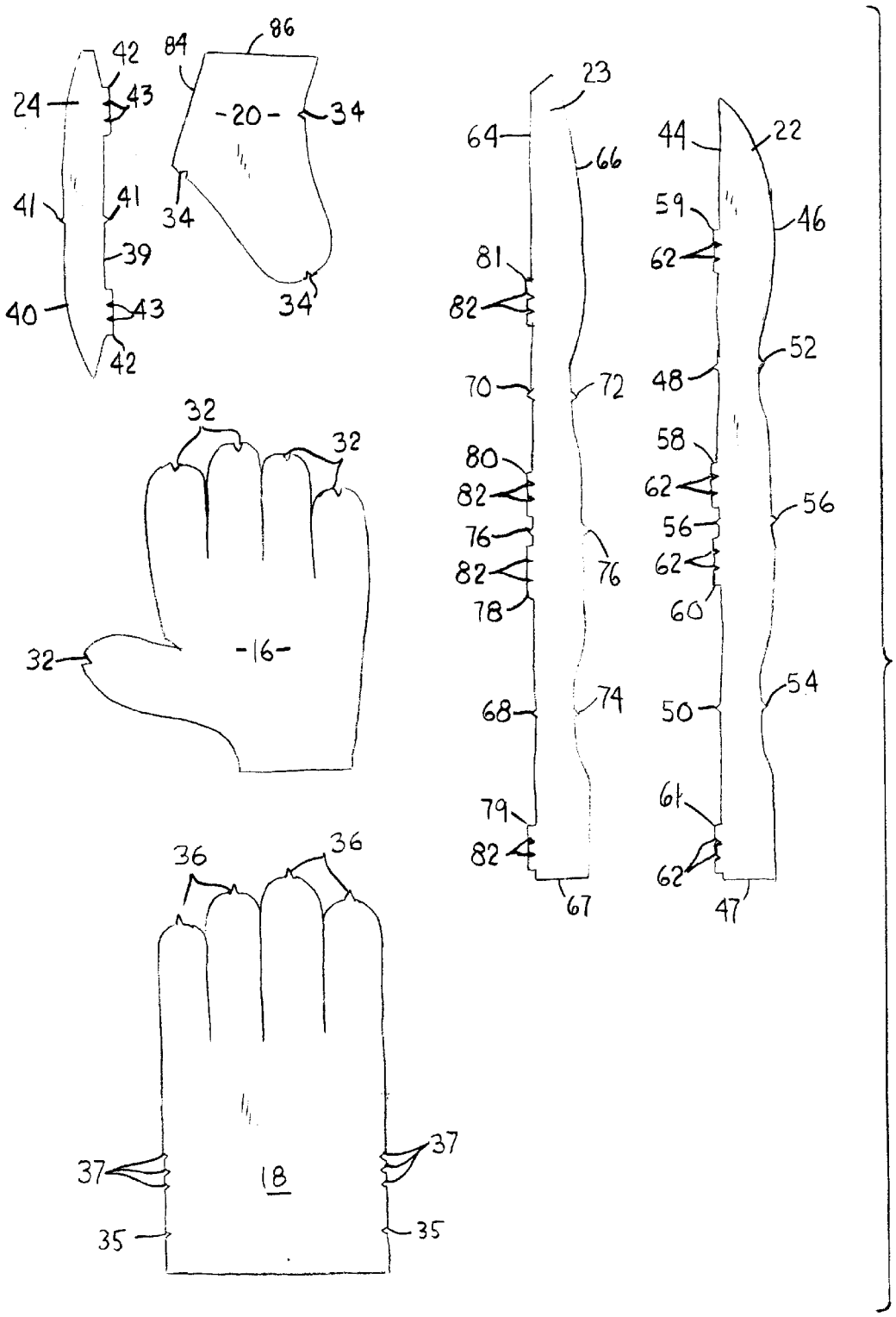
FIG. 9 is a plan view of the pattern pieces that are used to form each part of the present invention.

As best seen in FIG. 9, palm 16 is shaped like the anterior portion of a wearer's hand including finger portions (i.e., the thumb, index, middle, ring and little fingers) and a generally straight bottom edge. Palm 16 is preferably formed from a leather-type material as described above, but it is within the scope of this invention to construct palm 16 out of a rubber-like material to allow wearer to grip and hold on to objects. In particular, a set of indentations 32 are formed at the tips of each of the finger portions and thumb and are used to align fourchettes 22, 23, 24 prior to sewing palm 16 and fourchettes 22, 23, 24 to one another. It is within the scope of this invention to utilize other types of alignment mechanisms other than indentations 32 to correctly position the thumb and finger portions with fourchettes 22, 23.

As best seen in FIG. 9, top thumb portion 20 includes two generally straight sides 84, 86 with a curved portion extending therebetween. Preferably, top thumb portion 20 is longer than the thumb formed in palm 16. This size differential causes the thumb to curve inwardly toward palm 16 when thumb fourchette 24 is sewn between top thumb portion 20 and palm 16. A set of indentations 34 are preferably formed in the curved portion and are used to align top thumb portion 20 with thumb fourchette 24 before sewing them together. As with palm 16, it is within the scope of this invention to use other types of alignment mechanisms other than indentations 34 to correctly position the top thumb portion 20 and thumb fourchette 24 with respect to one another. Thumb portion 20 is preferably formed of a reflective aluminized material, but could be formed for leather, plastic or other material if protection form elevated temperatures is not desired.

As best illustrated in FIGS. 6 and 9, back portion 18 is shaped like the back of a wearer's hand having finger portions including an index finger, a middle finger, a ring finger and a little finger. A protrusion 36 is formed in the distal ends of each finger portion and are used to align fourchettes 22, 23 with the finger portions of back portion 18 when assembling glove 10. Back portion 18 further includes generally straight bottom and side edges. The side edges have additional indentations 37 formed therein that are used for forming tucks 28 in the back portion 18 and aligning the back portion 18 with the other pieces of glove 10 which will be more fully described below. A pair of indentations 35 are formed below indentations 37 and are used to align an elastic material, not shown, and thread 38 which will be more fully described below.

Back portion 18 is preferably made out of a radiant reflective aluminized material to help prevent a wearer from sustaining bums on the back of his or her hands due to exposure to elevated heat. However, it is within the scope of this invention to construct back portion 18 out of leather, plastic or other types of material if protection from elevated temperatures is not desired. Preferably, finger portions formed in the back portion 18 are longer than the fingers formed in the palm 16. As best seen in FIG. 2, the size differential between back portion 18 and palm 16 causes the fingers to curve inwardly toward palm 16 to form to a wearer's natural hand curvature when back portion 18 is sewn to palm 16.

As best seen in FIG. 6, a thread 38 extends across the bottom of back portion 18 and is preferably made out of a shearing elastic thread. Specifically, thread 38 is sewn in a zig-zag pattern and couples an elastic material, not shown, to an interior portion of back portion 18. As best seen in FIG. 1, the elastic material gathers the back portion 18 as the elastic material extends from the right peripheral edge to the left peripheral edge between indentations 35. When a wearer puts on glove 10, thread 38 and the elastic material stretches outwardly to position the bottom of back portion 18 against the back portion of a wearer's hand.

Thumb fourchette 24 is best illustrated in FIGS. 1 and 9. Thumb fourchette 24 is preferably formed of a radiant reflective aluminized material, but could be made from a leather material, such as cowhide, deerskin, elkskin, pigskin, digital leather or any combination thereof. Thumb fourchette 24 is an elongated piece that is used to form the sidewall of the thumb having a first and second edge 40, 39. First and second edge 40, 39 converge to form a straight edge at the top portion and form a point at the bottom portion of thumb fourchette 24. Second edge 39 is adapted to couple with the peripheral edge of the thumb portion of palm 16. First edge 40 is adapted to couple with the peripheral edge of the curved portion on top thumb portion 20. There are tabs 41 that extend outwardly from first and second edges 40, 39 that are adapted to align with the center indentations 32, 34 formed in the thumb portion of palm 16 and in the center of the curved portion of top thumb portion 20 respectively. In addition, thumb fourchette 24 includes two generally rectangular-shaped protrusions 42 that are positioned near the knuckle area of a wearer's thumb and extend outwardly from the second edge 39 that are used to hold tuck 26 in place. Notches 43 are formed in protrusions 42 to allow for the proper alignment and folding of thumb fourchette 24 to form tuck 26 which will be discussed more fully below.

First fourchette 22 is best illustrated in FIGS. 2 and 9. Fourchette 22 is formed of a radiant reflective aluminized material but could be made from a leather-type material as described above. Fourchette 22 is an elongated piece that is used to form the sidewalls for the index and middle fingers on glove 10 having first and second edges 44, 46. First and second edges 44, 46 converge at one end of first fourchette 22 and form a generally straight edge 47 at the opposite end. As best seen in FIG. 4, first edge 44 is adapted to couple with the peripheral edge of the index and middle fingers formed in palm 16. Second edge 46 is has a generally curved shape and is adapted to couple with the peripheral edge of the index and middle fingers formed in back portion 18.

Tabs 48, 50 are positioned on first edge 44 and are adapted to align first fourchette 22 with the indentations 32 in the middle and index fingers on palm 16 respectively. Tabs 52, 54 are positioned on second edge 46 and are adapted to align first fourchette 22 with the protrusion 36 in the middle and index fingers on back portion 18 respectively. Tabs 56 are used to indicate the base of the index and middle fingers when glove 10 is constructed. In addition, a set of generally rectangular-shaped protrusions 58, 59, 60, 61 extend outwardly from the first edge 44 in the knuckle area of a wearer having notches 62 formed therein to aid in forming tucks 26. The protrusions 58, 59, 60, 61 are additional material that extend from second edge 44 that are used to secure tucks 26 when fourchette 22 is sewn to palm 16. Further, protrusions 58, 59 are preferably positioned on either side of and equidistant from tab 48 so as to be associated with the index finger when glove 10 is assembled. Similarly, protrusions 60, 61 are positioned on either side of and equidistant from tab 50 so as to be associated with middle finger of palm 16 when glove 10 is assembled.

Second fourchette 23 is best illustrated in FIGS. 2 and 9. Fourchette 23 is structurally similar to first fourchette 22 and is also formed of a radiant reflective aluminized material, but could be made from a leather-type material as described above. Fourchette 23 is an elongated piece that is used to form the sidewalls for the ring and little fingers on glove 10 having first and second edges 64, 66. First and second edges 64, 66 are angled at one end and form a generally straight edge 67 at its opposite end. It should be understood and appreciated that it is within the scope of the present invention to straighten the angled end so it is generally perpendicular with edges 64, 66. For instance, straightening the angled edge could be done when making a glove in a smaller size. First edge 64 is adapted to couple with the peripheral edge of the ring and little fingers formed in palm 16. Second edge 66 is has a curved shape and is adapted to couple with the peripheral edge of the ring and little fingers formed in back portion 18.

Tabs 68, 70 are positioned on first edge 64 and are used to align second fourchette 23 with the indentations 32 in the ring and little fingers on palm 16 respectively. Tabs 72, 74 are positioned on second edge 66 and are used to align fourchette 23 with the protrusions 36 in the ring and little fingers on back portion 18 respectively. Tabs 76 are used to indicate the joint at the base of the ring and little fingers. In addition, a set of generally rectangular-shaped protrusions 78, 80 extend outwardly from the first edge 64 in the knuckle area of a wearer having notches 82 formed therein to aid in forming tucks 26. The protrusions 78, 79, 80, 81 are additional material that extend from first edge 64 that are used to secure tucks 26 when fourchette 23 is sewn to palm 16. Further, protrusions 78, 79 are preferably positioned on either side of and equidistant from tab 68 and will be associated with the ring finger when glove 10 is assembled. Similarly, protrusions 80, 81 are positioned on either side of and equidistant from tab 70 and will be associated with little finger of palm 16 when glove 10 is assembled.

Figure 7:
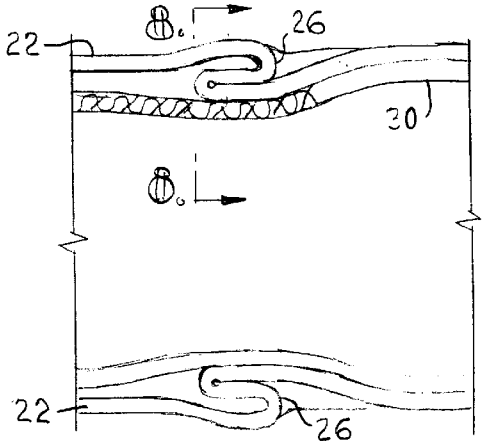
FIG. 7 is a fragmentary cross-sectional view taken along line 7—7 of FIG. 2 showing the tucks on both sides of the finger.

Lining 30 is best illustrated in FIGS. 4 and 7 and is used as the interior shell of glove 10. Specifically, lining 30 covers the interior portion of collar 14 and extends into the fingers and thumb. Lining 30 is preferably formed of materials, such as, but not limited to, THINSULATE, VELLUX, CROSSTECH, self-extinguishing fiber (SEF), gortex, pile, thermal, nylon or fleece. The lining 30 is sewn to the collar 14, palm 16, back portion 18 to prevent lining 30 from pulling out when a wearer removes his or her hand from glove 10.

In assembling glove 10, all of the pieces herein described are sewn together, but it is within the scope of this invention to construct glove 10 by using glue, mechanical fasteners or any other types of adhesive material for attaching the pieces to one another. First, the elastic material, not shown, is coupled to the interior portion of back portion 18 and extends between indentations 35. As seen in FIGS. 1 and 6, tucks 28 are constructed by first folding the bottom straight edge of back portion 18 on top of the back portion 18 at each of the middle indentations 37 so that the outer indentations 37 align with one another. Back portion 18 is folded a second time so that the back portion is folded over itself and the bottom straight edge extends in its original direction, while keeping the outer indentations 37 aligned with one another. Tucks 28 are then sewn and held into place on back portion 18.

Next, finger fourchettes 22, 23 are coupled to one another along edges 47, 67. Second edges 46, 66 of first and second fourchettes 22, 23 are sewn to the peripheral edge of the index, middle, ring and little finger portions on the back portion 18 after tabs 52, 54, 72, 74 are aligned with the protrusions 36 in back portion 18. Top thumb portion 20 and thumb fourchette 24 are sewn together along first edge 40 after aligning notches 41, 34.

As best seen in FIG. 1, fourchettes 22, 23 are folded in such a way to form tucks 26 on both sides of the index, middle, ring and little finger knuckles. Specifically, as best seen in FIGS. 2, 3, 7 and 8, tucks 26 in fourchette 22 are constructed by folding fourchette 22 at protrusions 58, 59, 60, 61 and sewing the overlapping portions. In particular, fourchette 22 is folded so that notches 62 on protrusion 59 are aligned with one other, and the pointed end of fourchette 22 is pointing toward straight edge 47. The pointed end of fourchette 22 is then folded a second time so that it is pointing in its original direction while keeping notches 62 aligned with each other. Keeping notches 62 aligned while the pointed end of fourchette 22 is pointing in its original direction creates an overlapping portion in fourchette 22. The overlapping portion is then sewn to hold it in place to create tuck 26. Similarly, fourchette 22 is folded so that notches 62 on protrusion 60 are aligned with one other, and the pointed end of fourchette 22 is pointing toward straight edge 47. The pointed end of fourchette 22 is then folded a second time so that it is pointing in its original direction while keeping notches 62 aligned with each other. Keeping notches 62 aligned while the pointed end of fourchette 22 is pointing in its original direction creates an overlapping portion in fourchette 22. The overlapping portion is then sewn to hold it in place to create another tuck 26.

Next, fourchette 22 is folded so that notches 62 on protrusion 58 are aligned with one other, and straight edge 47 is pointing toward the pointed end of fourchette 22. Straight edge 47 is then folded a second time so that it is pointing in its original direction while keeping notches 62 aligned with each other. Keeping notches 62 aligned while the pointed end of fourchette 22 is pointing in its original direction creates an overlapping portion in fourchette 22. The overlapping portion is then sewn to hold it in place to create tuck 26. Another tuck 26 on fourchette 22 is formed by folding fourchette 22 so that notches 62 on protrusion 61 are aligned with one other, and straight edge 47 is pointing toward the pointed end of fourchette 22. Straight edge 47 is then folded a second time so that it is pointing in its original direction while keeping notches 62 aligned with each other. Keeping notches 62 aligned while the pointed end of fourchette 22 is pointing in its original direction creates an overlapping portion in fourchette 22. The overlapping portion is then sewn to hold it in place to create yet another tuck 26.

The construction of the tucks 26 in fourchette 23 are similar to those formed in fourchette 22. Tucks 26 in fourchette 23 are constructed by folding fourchette 23 at protrusions 78, 79, 80, 81 and sewing the overlapping portions. In particular, fourchette 23 is folded so that notches 82 on protrusion 81 are aligned with one other, and the angled end of fourchette 23 is pointing toward straight edge 67. The angled edge of fourchette 23 is then folded a second time so that it is pointing in its original direction while keeping notches 82 aligned with each other. Keeping notches 82 aligned while the angled end of fourchette 23 is pointing in its original direction creates an overlapping portion in fourchette 23. The overlapping portion is then sewn to hold it in place to create tuck 26. Similarly, fourchette 23 is folded so that notches 82 on protrusion 78 are aligned with one other, and the angled end of fourchette 23 is pointing toward straight edge 67. The angled end of fourchette 23 is then folded a second time so that it is pointing in its original direction while keeping notches 82 aligned with each other. Keeping notches 82 aligned while the angled end of fourchette 23 is pointing in its original direction creates an overlapping portion in fourchette 23. The overlapping portion is then sewn to hold it in place to create another tuck 26.

Next, fourchette 23 is folded so that notches 82 on protrusion 80 are aligned with one other, and straight edge 67 is pointing toward the angled edge of fourchette 23. Straight edge 67 is then folded a second time so that it is pointing in its original direction while keeping notches 82 aligned with each other. Keeping notches 82 aligned while the angled end of fourchette 23 is pointing in its original direction creates an overlapping portion in fourchette 23. The overlapping portion is then sewn to hold it in place to create tuck 26. Another tuck 26 on fourchette 23 is formed by folding fourchette 23 so that notches 82 on protrusion 79 are aligned with one other, and straight edge 67 is pointing toward the pointed end of fourchette 23. Straight edge 67 is then folded a second time so that it is pointing in its original direction while keeping notches 82 aligned with each other. Keeping notches 82 aligned while the pointed end of fourchette 23 is pointing in its original direction creates an overlapping portion in fourchette 23. The overlapping portion is then sewn to hold it in place to create yet another tuck 26.

The length of the overlapping portions of fourchettes 22, 23 are approximately ⅜", but it will be understood and appreciated that the overlapping portions could be smaller or larger depending on the size glove that is constructed. It is also within the scope of this invention to include overlapping portions with the same or different lengths by varying the size of the protrusions and/or the spacing of the notches formed in the protrusions.

The sidewall of the thumb is now constructed. Specifically, thumb fourchette 24 is folded in such a way to form tucks 26 on both sides of the thumb knuckle as best seen in FIG. 1. As best seen in FIG. 7, tucks 26 formed in fourchette 24 are substantially similar to those formed in fourchettes 22, 23. Specifically, as best seen in FIGS. 7 and 9, tucks 26 are constructed by first folding fourchette 24 at the protrusions 42. Specifically, fourchette 24 is folded at the inner notches 43 in each protrusion 42 so that the straight and pointed ends are pointing toward each other. A second fold is made so that fourchette 24 is folded over itself to form an overlapping portion so that the straight and pointed ends extend away from each other and in their original direction. The overlapping portions of thumb fourchette 24 are tucks 26 and are approximately ⅜", but could be more or less depending on the size glove that is constructed. The overlapping portions in fourchette 24 are sewn to form tucks 26 for the wearer's thumb.

As best seen in FIGS. 1 and 9, second edge 39 of thumb fourchette 24 is sewn to the peripheral edge of the thumb portion on palm 16 after the corresponding notch 41 and indentation 32 have been aligned. Tucks 26 are preferably positioned on both sides of the knuckle of the thumb. The protrusions 42 that extend from the second edge 39 provide additional material along the sewing line between second edge 39 and the thumb portion on palm 16 to securely fasten tucks 26 so they will not come loose after second edge 39 and the thumb portion on palm 16 are sewn together. As best seen in FIG. 9, the bottom portion of the right edge located on back portion 18 is sewn to edge 84 on top thumb portion 20.

Preferably, collar 14, back portion 18, top thumb portion 20 and fourchettes 22, 23, 24 are formed from a radiant reflective aluminized material that is capable of protecting a wearer from elevated temperatures. With reference to FIG. 4, the aluminization extends approximately 210 degrees around the circumference of each finger. In particular, the aluminization extends from the first edge 44, 66 of fourchettes 22, 23, around the back portion 18 and to the first edge 44, 66 of the fourchettes 22, 23 on the opposite side of the finger. The thumb also has the same degree of aluminization coverage around its circumference formed from fourchette 24 and top thumb portion 20. The bottom edge of palm 16, edge 86 on top thumb portion 20 and the bottom edge of back portion 18 are sewn to a second peripheral edge of collar 14.

Figure 8:
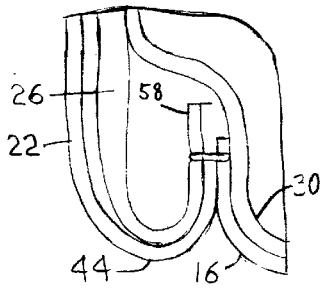
FIG. 8 is a fragmentary cross-sectional view taken along the line 8—8 of FIG. 7 showing the tucks constructed in the fourchette of each finger.

To close glove, as best seen in FIG. 3, the first edge 44 of first fourchette 22 is then sewn to palm 16 in the index and middle finger portions on palm 16. Tucks 26 are preferably positioned on both sides of the knuckle of the index and middle fingers, and tabs 48, 50 are aligned with the corresponding indentations 32 on palm 16. As seen in FIG. 8, protrusions 58, 59, 60, 61 located on fourchette 22 extend from the first edge 44 and provide additional material along the sewing line between first edge 44 and palm 16 to securely fasten tucks 26 so they will not come loose after first edge 44 and the finger portions on palm 16 are sewn together.

Next, first edge 64 of second fourchette 23 is sewn to the peripheral edge of the ring and little finger portions on palm 16 as shown in FIGS. 3 and 4. Tucks 26 are preferably positioned on both sides of the knuckle of the ring and little fingers, and tabs 68, 70 are aligned with the corresponding indentations 32 on palm 16. As seen in FIG. 8, protrusions 78, 79, 80, 81 located on fourchette 23 extend from the first edge 64 and provide additional material along the sewing line between first edge 64 and palm 16 to securely fasten tucks 26 so they will not come loose after first edge 64 and the finger portions on palm 16 are sewn together.

Lining 30 may be attached to the glove and sewn to the first peripheral edge of collar 14 and positioned within the cavity of glove 10. As best seen in FIGS. 4 and 9, lining 30 is sewn to the edges 40, 46, 66 of the fingers and thumb to prevent lining 30 from being dislodged when a wearer removes his or her hand from glove 10.

As seen in FIG. 1, arching member 31 is sewn to the bottom portion of cuff 12, and cuff 12 is sewn to a first peripheral edge of collar 14.

While the disclosed embodiment shows and makes reference to a glove that is adapted to fit the left hand of a wearer, it should be understood that it is within the scope of this invention to include the present invention on a glove adapted to fit a right hand of a wearer. In addition, it should be understood and appreciated that the present invention can be constructed on numerous types of gloves including but not limited to mittens.

In operation, as seen in FIG. 1, glove 10 has a predisposed curvature to conform to a wearer's natural hand position. This curvature is achieved due to the positioning of tucks 26 near the knuckles of a wearer, positioning of tucks 28 on the back of the glove, and the size differential between palm 16 and back portion 18. In particular and as best seen in FIG. 2, the finger of glove 10 has a slight curvature when in a natural or static position. Tucks 26, 28 operate to pull the edges 40, 46, 66 and the distal ends of the fingers and thumb and back portion inwardly toward palm 16. In addition, since back portion 18 is larger than palm 16, the back portion 18 is drawn inwardly toward palm 16 when sewn together with fourchettes 22, 23, 24.

Glove 10 is preferably used when entering an environment having elevated temperatures. As wearer's hand enters glove 10, thread 38 and the elastic material, not shown, expand to conform to the size of a wearer's hand and keeps back portion 18 snugly positioned against the back of a wearer's hand. The positioning of tucks 26 on both sides of the knuckle makes it easier for a wearer to bend his or her fingers. Tucks 26 are constructed in such a way to gather a portion of the material on both sides of the knuckle area to pre-form a bending crease. As best seen in FIG. 5, when a finger is moved to a flexed position, fourchette 22 utilizes the bending crease formed by tuck 26 thereby reducing the resistance that is normally encountered when a wearer bends his or her finger. It should be understood that tuck 26 on the thumb operates in substantially the same way as those tucks located on the fingers.

By constructing the glove in accordance with the method described above, not only does the present invention provide for improved flexibility and reduced hand and finger fatigue of a wearer, the NFPA standards for providing a firefighters glove with radiant reflective protection of 210 degrees (+20°/−0°) around the fingers, thumb and the back of the hand has been achieved. In particular, the construction of glove 10 that includes a back portion 18, thumb portion 20 and fourchettes 22, 23, 24 formed of a radiant reflective aluminized material provides a glove that protects 210 degrees (+20°/−0°) of a wearer's fingers. The construction of the present invention adequately protects a firefighter's hand from elevated temperatures and meets the aforementioned NFPA standard.

In summary, the present invention is directed to a glove that improves the flexibility and reduces the hand and finger fatigue of a wearer. The present invention has been described in relation to particular embodiments which are intended in all respects to be illustrative rather than restrictive. Alternative embodiments will become apparent to those skilled in the art to which the present invention pertains without departing from its scope.

From the foregoing, it will be seen that this invention is one well-adapted to attain the ends and aspects hereinabove set forth together with other advantages which are obvious and inherent to the structure. It will be understood that certain features and subcombinations are of utility and may be employed without reference to other features and subcombinations. This is contemplated by and is within the scope of the claims.

Having thus described the invention, what is claimed is:

1. A glove for improving flexibility and reducing hand and finger fatigue of a wearer, said glove having a palm and a back portion each with finger portions adapted to conform to the fingers of a wearer, said glove comprising:

a fourchette, said fourchette is adapted to couple the palm and back portions to form an enclosure for the wearer's fingers;

a first tuck, said first tuck is adapted to be formed in said fourchette and extending substantially across only the fourchette, thereby allowing for the easy movement of the wearer's fingers.

2. The glove as recited in claim 1, wherein said first tuck is positioned approximately in the middle of the finger portion.

3. The glove as recited in claim 1, further comprising a second tuck, wherein said second tuck is positioned on one side of a knuckle of a wearer and said first tuck is positioned on the opposite side of the same knuckle of a wearer.

4. The glove as recited in claim 1, further comprising a third tuck positioned on said back portion of the glove distal from the finger portions.

5. The glove as recited in claim 4, wherein said first and third tucks form the glove to the natural curvature of a wearer's hand.

6. The glove as recited in claim 1, wherein said fourchette and said back portion are formed of a radiant reflective material.

7. The glove as recited in claim 6, wherein said fourchette and said back portion cover approximately 210 degrees of the circumference of the finger with radiant reflective material.

8. The glove as recited in claim 1, wherein said finger portions on said back portion are longer than the finger portions on said palm portion thereby forming the glove to the natural hand curvature of the wearer.

9. A glove for improving flexibility, reducing hand and finger fatigue of a wearer and forming to the natural curvature of a wearer's hand, said glove comprising:

a palm, said palm having at least one finger portion formed therein;

a back portion, said back portion having at least one finger portion formed therein;

a sidewall, said sidewall coupling said palm to said back portion in the area of the finger portion, wherein said sidewall has a first tuck formed therein thereby allowing for easier movement of a wearer's finger; and wherein the palm, back portion and sidewall are formed from separate pieces of material.

10. The glove as recited in claim 9, wherein said first tuck is positioned approximately in the middle of the finger portion.

11. The glove as recited in claim 9, further comprising a second tuck, wherein said second tuck is positioned on one side of a knuckle of a wearer and said first tuck is positioned on the opposite side of the same knuckle of a wearer.

12. The glove as recited in claim 9, further comprising a third tuck positioned on said back portion of the glove distal from the finger portions.

13. The glove as recited in claim 9, wherein said sidewall and said back portion are formed of a radiant reflective material.

14. The glove as recited in claim 13, wherein said sidewall and said back portion cover approximately 210 degrees of the circumference of the finger with radiant reflective material.

15. The glove as recited in claim 9, wherein said finger portions on said back portion are longer than the finger portions on said palm thereby forming the glove to the natural curvature of the wearer's hand.

16. A method for constructing a glove that improves flexibility and reduces hand and finger fatigue of a wearer, said glove having a palm, a back portion and a fourchette, wherein said palm and back portion each including at least one finger portion, wherein said fourchette is adapted to couple said palm and said back portion, said method comprising the steps of:

coupling said palm and back portion with said fourchette; and forming a first tuck in said fourchette extending substantially across only the fourchette, thereby reducing the amount of force needed to bend the finger portion of the glove.

17. The method as recited in claim 16, wherein said first tuck is formed in said fourchette at approximately the middle of the finger portion of the glove.

18. The method as recited in claim 16, further comprising the step of forming a second tuck on one side of a knuckle on a finger and forming said first tuck on the opposite side of the same knuckle.

19. The method as recited in claim 16, further comprising the step of forming a third tuck in said back portion distal from the finger portions.

20. A glove for increasing flexibility and reducing hand and finger fatigue of a wearer, said glove having a palm and a back portion each with a finger portion, said glove comprising:

a fourchette, said fourchette adapted to couple the palm and the back portion, wherein said fourchette makes up the sidewall of the finger portion and is formed of a single, continuous piece of material extending from at least a point near the finger portion base to the finger portion base on the opposite side of the respective finger;

means for shaping the glove to the natural curvature of a wearer's hand.

21. The glove as recited in claim 20, wherein the palm, back portion and fourchette are each formed from separate pieces of material.

22. The glove as recited in claim 20, wherein the means for shaping the glove comprises a first tuck formed in the fourchette.

23. The glove as recited in claim 22, further comprising a second tuck formed in the fourchette, wherein said second tuck is positioned on one side of a knuckle of a wearer and said first tuck is positioned on the opposite side of the same knuckle of a wearer.

24. The glove as recited in claim 22, wherein said back portion and said fourchette are formed of radiant reflective material thereby protecting the back portion of a wearer's hands and the back and side portions of a wearer's fingers from elevated temperatures.

25. The glove as recited in claim 24, wherein said back portion and said fourchette cover approximately 210 degrees of the circumference of the finger with radiant reflective material.

26. A glove for improving flexibility and reducing hand and finger fatigue of a wearer, said glove comprising:

a palm including at least one finger portion;

a back portion having at least one finger portion; and a fourchette coupling said palm and back finger portions to one another, said fourchette having a first rectangular-shaped protrusion extending therefrom, wherein said fourchette is adapted to be folded in the location of said first protrusion to form a tuck on a side portion of said finger portion thereby allowing for the easy movement of a wearer's fingers.

27. A glove for improving flexibility and reducing hand and finger fatigue of a wearer, said glove comprising:

a palm including at least one finger portion;

a back portion having at least one finger portion; and a fourchette coupling said palm and back finger portions to one another, said fourchette having a first rectangular-shaped protrusion extending therefrom and positioned adjacent to the wearer's knuckle, wherein said fourchette is adapted to be folded in the location of said first protrusion to form a tuck on a side portion of said finger portion thereby allowing for the easy movement of a wearer's fingers.

28. The glove as recited in claim 27, further comprising:

a second rectangular-shaped protrusion positioned on the opposite side of the wearer's knuckle.

29. A glove for improving flexibility and reducing hand and finger fatigue of a wearer, said glove comprising:

a palm including at least one finger portion;

a back portion having at least one finger portion; and a fourchette coupling said palm and back finger portions to one another, said fourchette having a first rectangular-shaped protrusion extending therefrom and having at least one notch formed therein, wherein said fourchette is adapted to be folded in the location of said first protrusion to form a tuck on a side portion of said finger portion thereby allowing for the easy movement of a wearer's fingers.

30. A method for constructing a glove that improves flexibility and reduces hand and finger fatigue of a wearer, said method comprising:

providing for a palm having at least one finger portion;

providing for a back portion having at least one finger portion;

providing for a fourchette having a first edge and a second edge, wherein said fourchette includes a first rectangular-shaped protrusion extending from said first edge;

coupling said second edge of said fourchette to said back portion;

folding said first rectangular-shaped protrusion of said fourchette to form a tuck; and coupling said first edge of said fourchette to said palm.

31. The method as recited in claim 30, wherein said first rectangular-shaped protrusion extends from said first edge of said fourchette adjacent to the wearer's knuckle.

32. The method as recited in claim 31, further comprising:

a second rectangular-shaped protrusion extends from said first edge of said fourchette and is positioned on the opposite side of the wearer's knuckle.

33. The method as recited in claim 30, further comprising:

folding said back portion to form at least one tuck before sewing said back portion to said fourchette.

* * * * *